US005109951A

United States Patent [19]

Lecorre

[11] Patent Number: 5,109,951

[45] Date of Patent: May 5, 1992

[54] DEVICE FOR THE CURVED DISPLACEMENT OF AN OBJECT IN CONTACT WITH A SURFACE

[75] Inventor: Yves Lecorre, St. Nazaire, France

[73] Assignee: Polytec, Saint Nazaire, France

[21] Appl. No.: 634,736

[22] Filed: Dec. 27, 1990

[51] Int. Cl.[5] ..... E04G 21/00

[52] U.S. Cl. ..... 182/62.5; 182/69; 182/141; 248/277; 248/124; 254/122

[58] Field of Search ..... 182/63, 69, 141, 62.5; 248/277, 124, 299; 254/122

[56] References Cited

U.S. PATENT DOCUMENTS 828,709 8/1906 Buckland ..... 248/77

4,934,643 6/1990 Militano, Jr. ..... 248/124

FOREIGN PATENT DOCUMENTS 2384437 10/1978 France .

*Primary Examiner*—Alvin C. Chin-Shue

*Attorney, Agent, or Firm*—Pollock, VandeSande & Priddy

[57] ABSTRACT

Device for the curved displacement of an object in contact with a surface, such as a convex, concave or complex surface, comprising a vertical support frame, arranged in the vicinity of the surface, and a bearing arm consisting of at least one pantograph, one end of which, integral with the vertical support frame, can be displaced over the height of the latter, and the other end of which carries the object to be displaced at an appropriate distance from, and out of contact with, the surface, wherein at least one of the hinge pins of the arm of the pantograph is displaced, with the movement of the arm relative to the frame, in a groove whose profile is homothetic with that of the surface, and situated in a vertical plane containing the pantograph arm.

5 Claims, 2 Drawing Sheets

DEVICE FOR THE CURVED DISPLACEMENT OF AN OBJECT IN CONTACT WITH A SURFACE

FIELD OF THE INVENTION

The present invention relates to a device for the curved displacement of an object, parallel to the curvature of a surface of a given profile which may be convex, concave or complex.

BACKGROUND OF THE INVENTION

The invention applies more particularly, although not exclusively, to a device for the displacement of a working tool, brought into and held in contact with the convex surface, or alternatively of a support cradle for an employee who has to work on the said surface.

Numerous scaffolding or moveable-cradle systems are already known which can be erected in the vicinity of the surface of a large-dimension part or a similar installation, making it possible to follow the profile of this surface in order to carry out machining, finishing or checking operations thereon. Now these assemblies are generally difficult to construct and install, are relatively expensive and, above all, are poorly suited for following the convex, or even more complex, profile of the part, especially when the latter has large dimensions.

Devices are also known which, starting from a given fixed reference, make it possible to displace a given object or tool in two perpendicular directions. FR-A-2,384,437 thus makes use of a pantograph which can expand in a transverse direction and is carried by a support which is displaceable in a perpendicular direction by means of a control jack. Such an apparatus is more particularly suited to the positioning of a cradle behind an agricultural tractor and, in any case, would as such be unsuited to the construction of an assembly capable of following in regular fashion the profile of a convex surface of large dimensions.

Lastly, devices of a more sophisticated type are known which make it possible to follow the profile of any surface, reproducing at each instant the X and the Y co-ordinates of the successive points of the latter. However, such a device requires that these co-ordinates be memorized and the memorized data retrieved at an appropriate time, which generally results in the use of a complex and expensive electronic piece of equipment.

BRIEF DESCRIPTION OF THE INVENTION

The subject of the present invention is a device of a very simple design which makes it possible to follow the profile of the surface, in particular the convex, concave or complex surface, of a fragile and valuable part of large dimension, without possible faulty adjustments and therefore without the risk of impact, and without any memorizing of the co-ordinates of this surface, by virtue of an entirely mechanical assembly ensuring that an object carried by the device is held at a satisfactory distance from, and out of contact with, the surface, irrespective of the variations in the profile of the latter.

To this end, the device in question, comprising a vertical support frame arranged in the vicinity of the surface, and a support arm consisting of at least one pantograph, one end of which, integral with the vertical support frame, can be displaced as required depending upon the height of the latter, and the other end of which carries the object to be displaced in contact with the surface, is characterised in that at least one of the hinge pins of the pantograph arm is displaced, with the movement of the arm relative to the frame, in a groove whose profile is homothetic with that of the surface and is situated in a vertical plane containing the pantograph arm.

According to a particular feature of the device in question, the pantograph is formed from at least two adjacent scissors, two ends of the crossed limbs of the first scissors being freely articulated on two ends of the likewise crossed limbs of the second scissors, the first scissors having their opposite ends carried by the frame, whereas the opposite ends of the second scissors support the object to be displaced.

One of the ends of the first scissors, that carried by the frame, advantageously comprises a moveable nut which is free in translational movement and fixed in rotation, interacting with an axial lead screw, the rotation of which causes the nut to be displaced on the screw which extends vertically over the height of this frame. Likewise preferably, the second opposite end of the first scissors comprises a guide sleeve sliding freely on or relative to the lead screw.

Also, according to another feature, the opposite end of the second scissors, that fixed to the object to be displaced relative to the surface, is provided with a vertical rod parallel to the frame and on which slides a guide carried by the second end of the second scissors.

According to yet another feature, the groove in which slides the hinge pin of the limbs of the first or second scissors is machined in a plane plate carried by the frame and arranged in the vertical plane containing the arm of the pantograph.

Lastly, and in a particular embodiment of the invention, the object to be displaced consists of a cradle adapted for carrying employees for working on the surface, or alternatively any tool making it possible to carry out this work.

Other features of a device for controlling the curved displacement of an object in contact with a surface, in particular a convex surface, will become further apparent from the description which follows of an illustrative embodiment, given as a guide and with no limitation being implied, with reference to the attached drawings, in which:

DETAILED DESCRIPTION OF THE INVENTION

Figure 1:
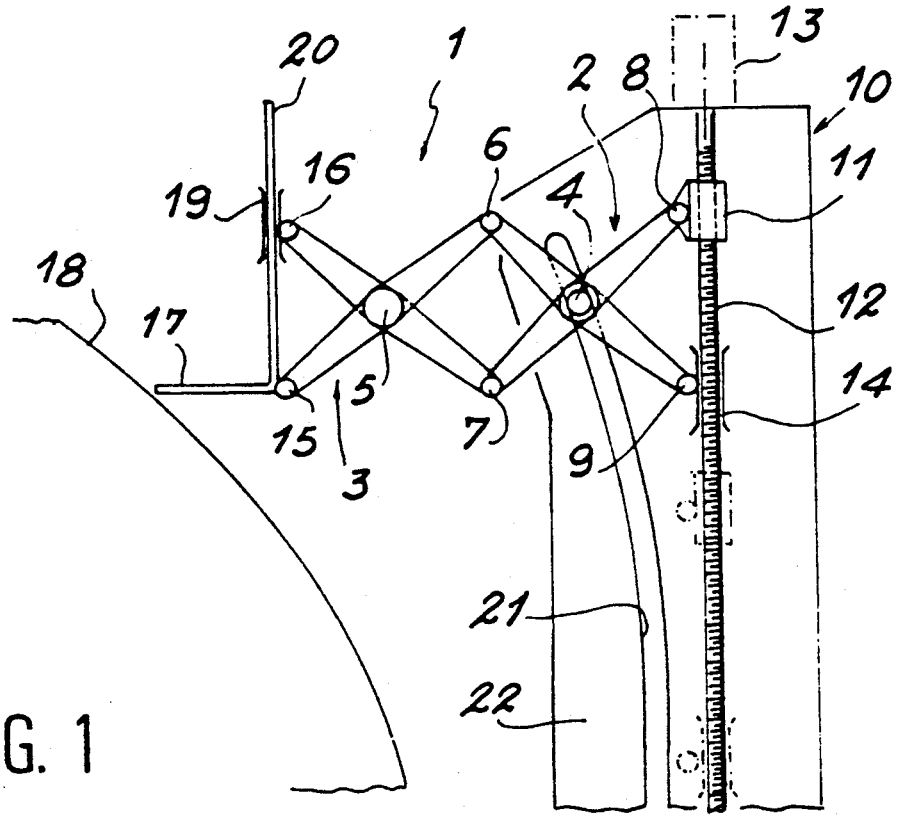
FIGS. 1 and 2 illustrate diagrammatically the means employed in the device of the invention, which device is shown in two different positions in contact with a convex surface, allowing the principle of the control of the displacement made in accordance with the profile of this surface to be readily understood.
Figure 2:
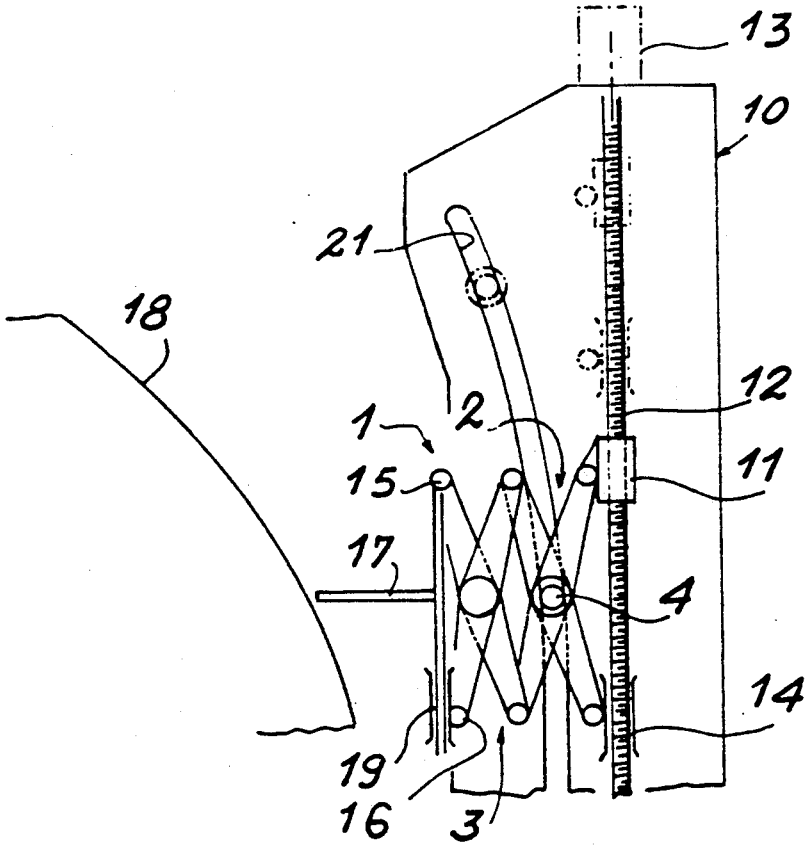

The device illustrated diagrammatically in FIGS. 1 and 2 is composed of a pantograph arm 1 which is itself formed from two successive scissors 2 and 3, the limbs of which are crossed and articulated on each other, respectively about horizontal pins 4 and 5 which are perpendicular to the plane of the figure. The two scissors are furthermore articulated with each other by way of their common ends joined together by pins 6 and 7 which are parallel to the pins 4 and 5.

The ends opposite the pins 6 and 7 of the first scissors 2 are in turn articulated about pins 8 and 9 which are parallel to the previous pins and carried by a frame 10. The pin 8 is integral with a nut 11 comprising an internal screw thread engaging with the external screw thread of a lead screw 12, extending vertically and supported by the frame 10 in such a way that the free rotation of this screw, controlled by a geared motor 13, makes it possible for the nut 11, which is itself fixed in rotation but free in translational movement, to be displaced on the frame from top to bottom or vice versa, carrying with it the pantograph arm 1. The pin 9 is connected to a sleeve 14 which is capable of sliding in the direction of the screw 12, as a function of the to and from movements of the crossed limbs of the first scissors 2. As an alternative, it is possible to transpose the sleeve 14 and the nut 11.

The two ends of the second scissors 3, those opposite the pins 6 and 7, comprise in a similar manner two parallel pins 15 and 16, the pin 15 being shown, in the layout diagram of FIG. 1, associated with an object 17 to be displaced in the vicinity of the outer surface 18 of a piece of equipment or of any installation, this surface preferably having a profile which is convex but which can, optionally, be concave or complex. The pin 16 has a guide 19 which can slide freely on a rod 20 carried by the object 17, this rod extending parallel to the screw 12.

According to the invention, at least one of the pins of the pantograph arm 1, for example the pin 4 about which the two limbs of the first scissors 2 are articulated, is mounted slidably in a groove 21 formed in a plate 22 carried by the frame 10 and extending vertically in the plane of the arm 1. The groove 21 is a continuous groove, the profile of which is homothetic with that of the surface 18 along which the object 17 is to be displaced, this displacement being effected as a result of the displacement of the nut 11 along the lead screw 12, from one end of the groove 21 to the other.

It can be understood that, depending on the position of the nut 11 on the height of the frame 10, the transverse distance which separates the pin 4 from the screw 12 will vary, gradually opening or closing the limbs of the first scissors 2 and, as a result of their articulated linkage about pins 6 and 7, simultaneously the limbs of the second scissors, moving the object 17 nearer or further away correlatively with respect to the fixed reference constituted by the screw 12 carried by the frame 10. Since the profile of the groove 21 is deduced directly from that of the surface 18 by homothetic transformation in accordance with a horizontal vector, the object 17 to be displaced can thus be permanently held in contact with the latter, irrespective of its position relative to this surface.

During the displacement of the nut 11, the sleeve 4 on the one hand and the guide 19 on the other hand slide freely on the lead screw 12 and the rod 20, permanently accommodating the variations in the opening or closing angles of the limbs of the scissors 2 and 3 about their pins 4 and 5 and ensuring satisfactory stability for the pantograph arm 1 and for the object to be displaced 17 mounted on the end of the latter, whilst at the same allowing this arm to retain a constant orientation in its plane coinciding with that of the plate 22 in which the groove 21 is formed.

It will, however, be noted that the relative position of the pins 15 and 16 at the ends of the second scissors 3 can be reversed, as shown in FIG. 2 in comparison with FIG. 1. Similarly, the object 17 to be displaced in contact with the surface 18 is not necessarily arranged at right angles to the pin 15 but can be offset in order to be situated at any point of the rod 20, as also shown in FIG. 2.

Figure 3:
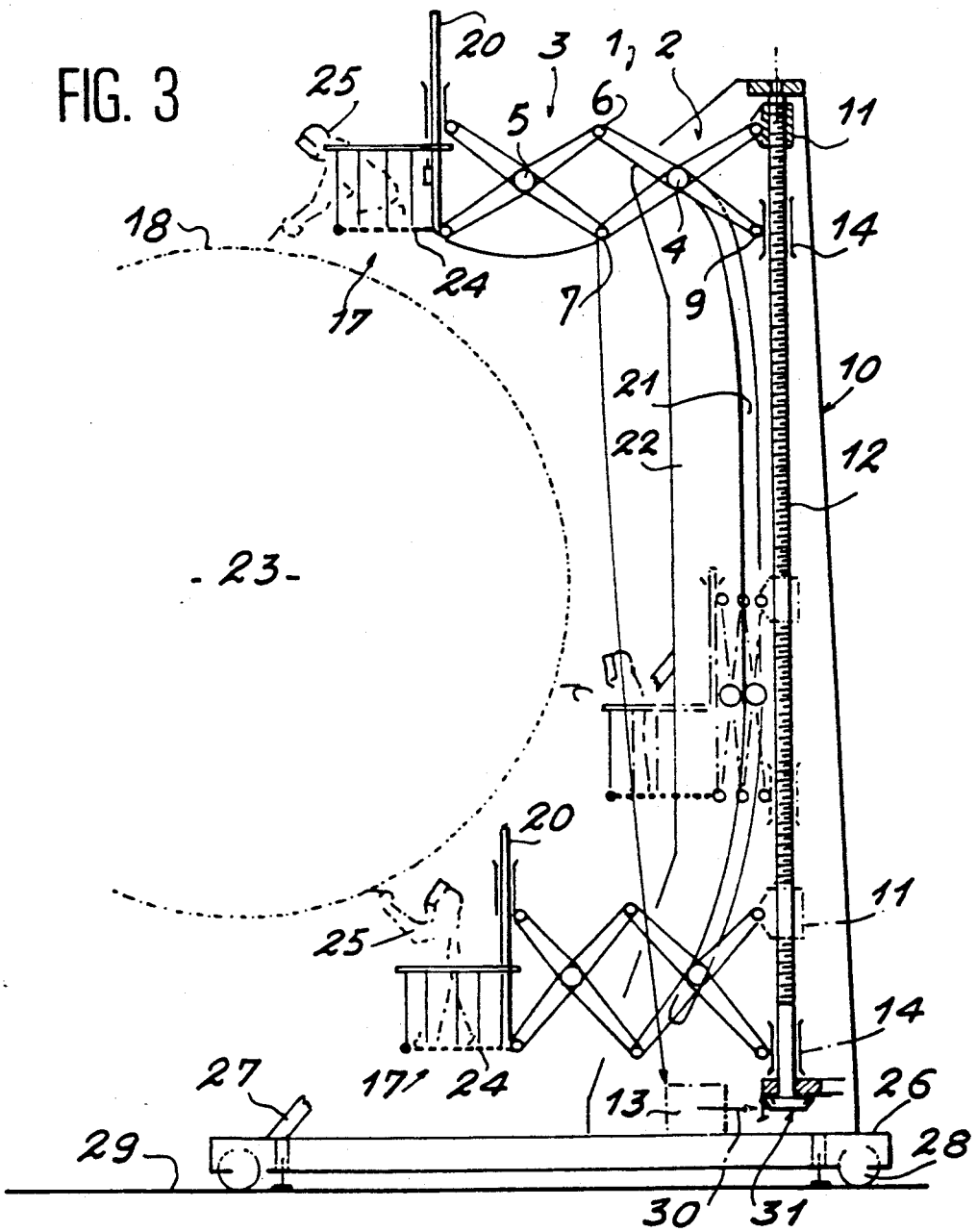
FIG. 3 is a more detailed view in elevation of a particular embodiment of the device.
Figure 4:
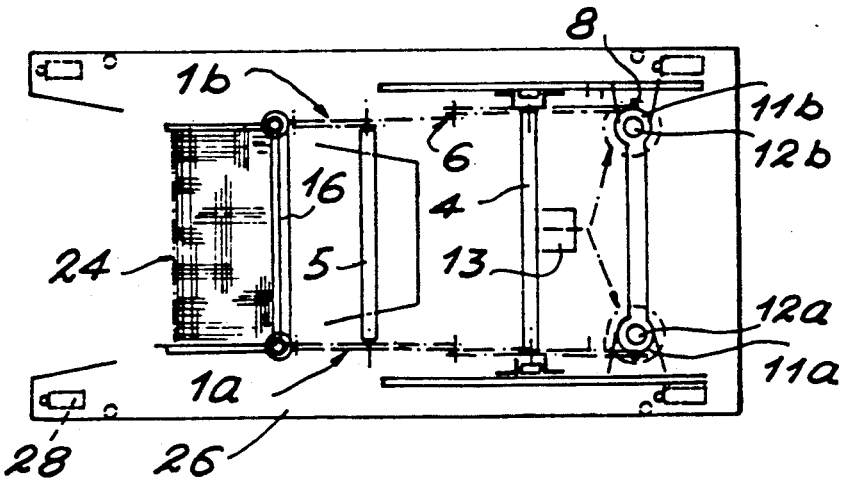
FIG. 4 is a diagrammatic top view of the device illustrated in FIG. 3.

In the embodiment more particularly illustrated in FIGS. 3 and 4, the essential means described above are to be found again, allocated the same reference numerals. The surface 18 is here assumed to be that of a horizontal-axis cylinder 23 constituting a large-dimension part, in particular of the type which can be found in units manufacturing aeronautical equipment or railway vehicles or alternatively of the reservoir, tank or other type. The object 17 consists of a cradle 24 which is integral with the rod 20 on which slides the guide 19, this cradle making it possible for a worker 25 to be moved to any point of the surface 18 in order to work on the latter, carrying out any desired machining, grinding, finishing, maintenance or cleaning operation. It is, of course, self-evident that the cradle 24 could in the same way serve as a support for a working tool which is or is not remote-controlled, for carrying out any operation on the surface 18 of the part 23.

The frame 10 carrying the screw 12 is mounted on a horizontal support 26 comprising props 27 capable of holding the frame and the plate 22 in a vertical plane. The support can, for example, have wheels 28 allowing it to be moved on the ground 29 in order to bring the assembly nearer to the cylinder 23 before the cradle 24 is moved into the vicinity of the latter. The support can, of course, be fixed without going beyond the scope of the invention. In the drawing in FIG. 3 the geared motor 13 has been shown arranged on the support 26, its output shaft 30 driving a conical-pinion gearing 31 for driving the screw 12 in rotation.

Although the cradle 24 can be supported by a single pantograph arm 1, it can be clearly seen that the stability of the device is greatly improved by arranging the cradle cantilevered on two identical and parallel pantograph arms la and lb respectively, shown diagrammatically in FIG. 4, the pins 4, 5, 6, 7, 8, 9, 15 and 16 being common to these arms which have two nuts **11*a* and 11*b* interacting with two parallel driving screws 12*a* and 12*b* carried by the frame and driven in synchronism from the geared motor 13**.

A device is thus formed for the curved displacement of an object in contact, with a surface, in particular a convex, concave or complex surface, of very simple design and in which the object retains a constant orientation irrespective of the profile of this surface, the groove for guiding the frame causing the lateral displacement movements of the pantograph arm, without requiring the intervention of complex electronic units memorizing the co-ordinates of this profile from one end of the corresponding surface to the other. This device can furthermore easily be adapted to different surface profiles, simply by replacing the plate carrying the groove which is an image of each desired profile.

It is, of course and as follows from the above, self-evident that the invention is not limited just to the illustrative embodiment described and shown above; on the contrary, it embraces all alternatives liable to fall within the scope of the claims which follow. In particular, and depending on the distance which separates the frame from the surface against which the object is to be displaced, the pantograph arm can have a number of scissors articulated in series which is greater than two as long as it has a sufficient mechanical strength to enable the object to be supported cantilevered at the end of the arm.

I claim:

1. An apparatus for following the curvature of a surface, and comprising:

a threaded support;

a pantograph having at least two adjacent scissor sections pivotally connected;

a first end of the pantograph being threadably mounted to the support for translation therealong;

a second end of the pantograph being adjacent the first end;

means for movably mounting the second pantograph end to the threaded support for linking translation of the first and second ends along the threaded support;

a third end of the pantograph being pivotally mounted to an object which follows the surface curvature;

a fourth end of the pantograph movably mounted to the object, the third and fourth ends defining a line parallel to the threaded support;

a curved groove located in the plane of the pantograph;

a central hinge pin of one of said scissor sections located in the groove for following a profile of the groove; and means for rotating the threaded support thereby adjusting the length of the pantograph and swinging the object along an arc coaxial with the surface curvature.

2. The apparatus set forth in claim 1 wherein the means for movably mounting the second pantograph end to the threaded support is a first journal mounted on the threaded support, and pivot means connecting the journal to the second pantograph end.

3. The apparatus set forth in claim 1 wherein the means for movably mounting the fourth pantograph end is a second journal mounted on the object, and pivot means connecting the second journal to the fourth pantograph end.

4. The apparatus set forth in claim 1 wherein the groove is machined in a plate located in the plane of the pantograph, the plate located in stationary relation to the threaded support.

5. The apparatus set forth in claim 1 wherein the object comprises a carrier for holding an individual performing work on the surface.

* * * * *